US009306320B2

(12) United States Patent
Kataoka et al.

(10) Patent No.: US 9,306,320 B2
(45) Date of Patent: Apr. 5, 2016

(54) CONNECTOR

(71) Applicant: Sumitomo Wiring Systems, Ltd., Yokkaichi (JP)

(72) Inventors: Shigeto Kataoka, Yokkaichi (JP); Takashi Matsuda, Yokkaichi (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 14/465,953

(22) Filed: Aug. 22, 2014

(65) Prior Publication Data

US 2015/0056846 A1 Feb. 26, 2015

(30) Foreign Application Priority Data

Aug. 23, 2013 (JP) ..... 2013-173025

(51) Int. Cl.

| | |
|---|---|
| ***H01R 13/508*** | (2006.01) |
| ***H01R 13/58*** | (2006.01) |
| ***H01R 13/506*** | (2006.01) |
| *H01R 13/52* | (2006.01) |
| *H01R 13/56* | (2006.01) |
| *H01R 107/00* | (2006.01) |

(52) U.S. Cl.

CPC ..... *H01R 13/5804* (2013.01); *H01R 13/506* (2013.01); *H01R 13/5208* (2013.01); *H01R 13/56* (2013.01); *H01R 2107/00* (2013.01)

(58) Field of Classification Search

CPC ..... H01R 13/506; H01R 13/5804

USPC ..... 439/456, 157, 587, 588, 589, 902, 345, 439/596, 468, 471

See application file for complete search history.

(56) References Cited

U.S. PATENT DOCUMENTS

| | | | | |
|---|---|---|---|---|
| 8,568,159 | B2 * | 10/2013 | Noda | H01R 13/5812 439/470 |
| 2009/0305536 | A1 * | 12/2009 | Martin | H01R 13/62955 439/157 |
| 2011/0312198 | A1 * | 12/2011 | Komiyama | H01R 13/62977 439/157 |

FOREIGN PATENT DOCUMENTS

| | | |
|---|---|---|
| JP | 2013-020774 | 1/2013 |

* cited by examiner

*Primary Examiner* — Tulsidas C Patel
*Assistant Examiner* — Marcus Harcum
(74) *Attorney, Agent, or Firm* — Gerald E. Hespos; Michael J. Porco; Matthew T. Hespos

(57) ABSTRACT

Terminal fittings (110) connected to end parts of wires (200) are inserted into cavities (16) of a housing (11). A seal (60) is arranged on a rear surface side of the housing (11), and a holder (40) is arranged on a rear side of the seal (60). A wire cover (70) is arranged rotatably from an open position to a closed position on a rear side of the holder (40). The wire cover (70) includes cover-side rotation center portions (76). The holder (40) includes holder-side rotation center portions (47) configured to support the cover-side rotation center portions (76) and constituting a center of rotation of the wire cover (70).

8 Claims, 10 Drawing Sheets

CONNECTOR

BACKGROUND OF THE INVENTION

1. Field of the Invention

The invention relates to a connector.

2. Description of the Related Art

Japanese Unexamined Patent Publication No. 2013-20774 discloses a connector with a housing that has cavities for receiving terminal fittings connected to end parts of wires. A one-piece seal is arranged on a rear surface side of the housing and has seal holes at positions communicating with the cavities. A holder is arranged on a rear surface of the seal and has through holes at positions communicating with the seal holes. A wire cover is arranged to cover the wires pulled out from a rear surface of the holder. The terminal fittings are inserted through the through holes and the seal holes and into the cavities of the housing. The wire is maintained in the seal hole in a liquid-tight manner and is disposed loosely in the through hole when the terminal fitting is inserted properly into the cavity.

Further, the wire cover is guided and held on the housing by fitting rear and front guides on the wire cover into front and rear guide grooves on the housing.

The wire cover can be configured to be supported rotatably between an open position and a closed position with respect to the housing and covers the wires at the closed position. Such a rotational wire cover could have a cover-side rotation center on the wire cover and a housing-side rotation center on the housing. The wire cover then could be rotated toward the closed position while the cover-side rotation center is supported on the housing-side rotation center. However, if the housing-side rotation center and a holder are adjacent to each other on the rear surface of the seal, a clearance is provided between the housing-side rotation center and the holder and the connector may be enlarged by that much.

The invention was completed based on the above situation and aims to prevent the enlargement of a connector.

SUMMARY OF THE INVENTION

The invention is directed to a connector with a housing that includes at least one cavity into which at least one terminal fitting is to be inserted. A seal is arranged on a rear surface of the housing and includes at least one seal hole at a position communicating with the cavity. The wire is pulled out from the rear surface of the housing and is disposed in the seal hole in a liquid-tight manner. A holder is arranged on a rear of the seal and has at least one through hole at a position communicating with the seal hole. The wire pulled out from the rear surface of the seal is disposed loosely in the through hole. The connector further has a wire cover that is rotatable from an open position to a closed position with respect to a rear surface side of the holder and that covers the wire pulled out from the rear surface side of the holder at the closed position. The wire cover includes a cover-side rotation center, and the holder includes a holder-side rotation center configured to support the cover-side rotation center and constituting a center of rotation of the wire cover.

Since the cover-side rotation center of the wire cover is supported on the holder-side rotation center of the holder and the holder integrated with the holder-side rotation center is rearward of the seal with good space efficiency. Thus, enlargement of the connector is prevented.

Two cover-side rotation centers may be provided on the wire cover. A housing-side rotation center configured to support a cover-side rotation center different from the cover-side rotation center to be engaged with the holder-side rotation center and constituting the center of rotation of the wire cover together with the holder-side rotation center portion may be provided at a position at a side of the holder opposite to the holder-side rotation center and on a rotation axis passing through the holder-side rotation center. Since the holder-side rotation center is provided at one side on the rotation axis of the wire cover and the housing-side rotation center is provided at the other side, if it is attempted to mount the holder on the rear side of the housing in a posture inverted from a proper posture with respect to a center of the rotation axis, the holder-side rotation center portion and the housing-side rotation center portion interfere with each other, thereby preventing any further mounting of the holder. As a result, erroneous mounting of the holder is prevented.

The housing may include a lever accommodating chamber for accommodating a lever, and the housing-side rotation center may be coupled integrally to a peripheral wall of the lever accommodating chamber. Since the peripheral wall of the lever accommodating chamber is reinforced by the housing-side rotation center, the lever is accommodated stably in the lever accommodating chamber.

DETAILED DESCRIPTION

Figure 1:
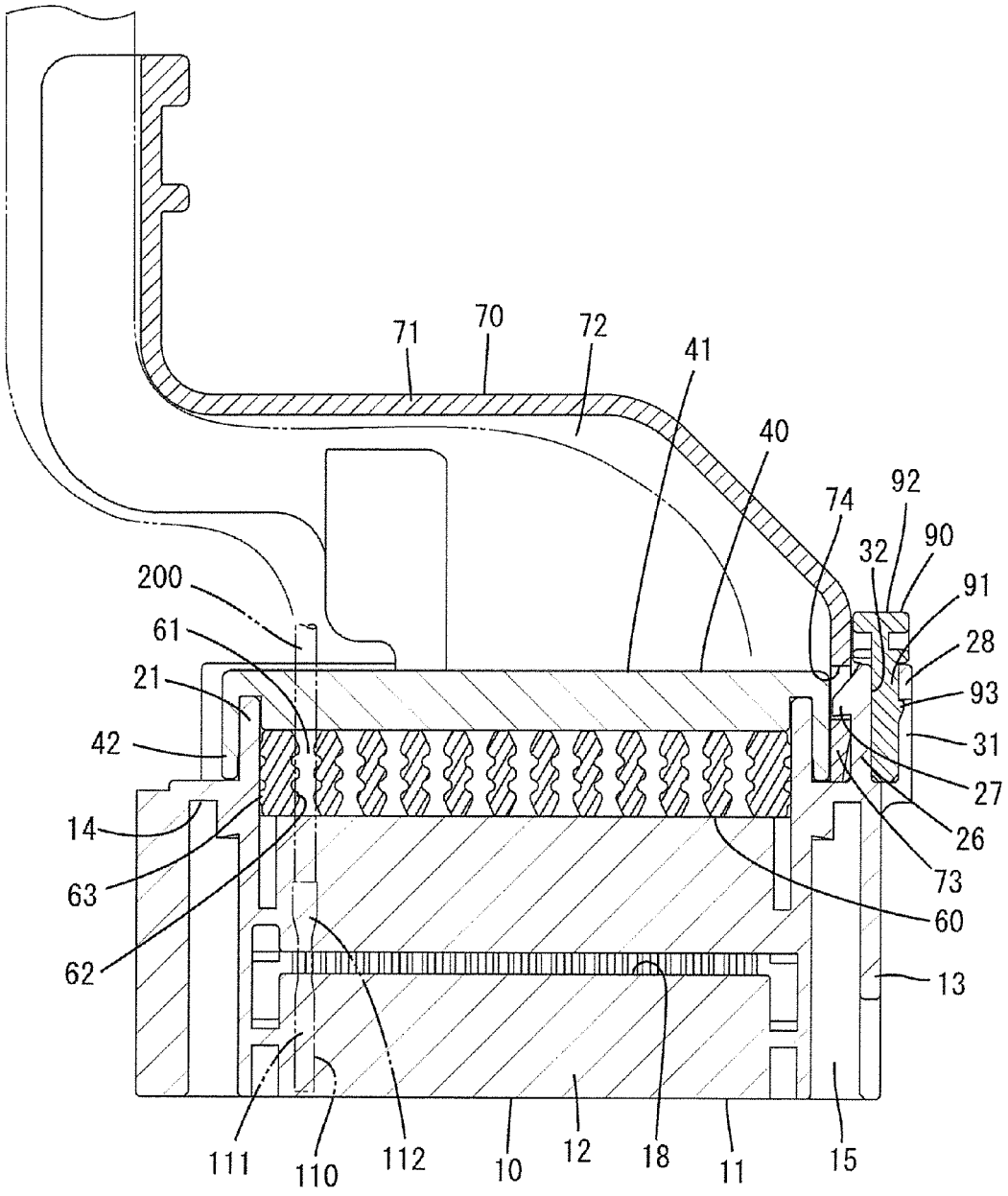
FIG. 1 is a section of a connector according to one embodiment of the invention.

A connector in accordance with an embodiment of the invention is described with reference to FIGS. 1 to 11. The connector of this embodiment includes a housing 10, a seal 60, a wire cover 70, a restricting member 90 and terminal fittings 110 as shown in FIG. 1. The housing 10 comprises a housing portion 11 and a holder 40, which are assembled in a state where the seal 60 is sandwiched between the housing portion 11 and the holder 40. The housing 10 is connectable to an unillustrated mating housing. Note that, in the following description, a side where the mating housing is located at the start of connection is referred to as a front concerning a front-back direction and a vertical direction is based on FIGS. 2 and 7.

As shown in FIG. 1, the housing portion 11 includes a terminal accommodating portion 12 substantially in the form of a rectangular block, a substantially rectangular fitting tube 13 surrounding the terminal accommodating portion 12 and a plate-like coupling 14 connected to the fitting tube 13 and the terminal accommodating portion 12 at a rear end part and extending along a height direction. A forwardly open connection space 15 is provided between the terminal accommodating portion 12 and the fitting tube 13 forward of the coupling 14 and can receive the mating housing.

Figure 7:
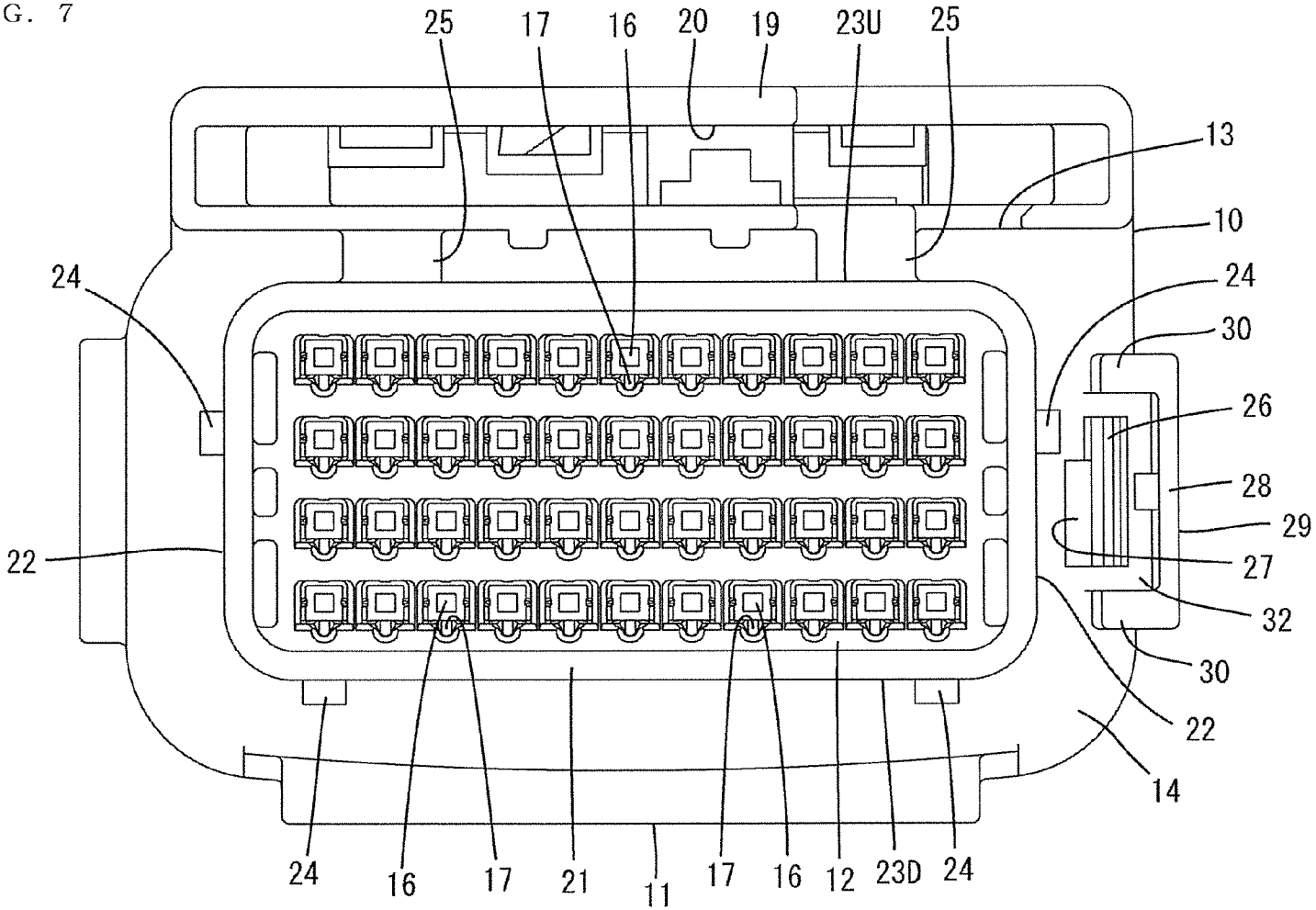
FIG. 7 is a rear view of a housing portion.

As shown in FIG. 7, cavities 16 penetrate through the terminal accommodating portion 12 in the front-back direction. A deflectable locking lance 17 projects at an inner surface of each cavity 16. The terminal fitting 110 is inserted into each cavity 16 of the terminal accommodating portion 12 and the properly inserted terminal fitting 110 is retained by the locking lance 17. As shown in FIG. 1, the terminal fitting 110 is formed by bending a unitary electrically conductive metal plate, and includes a box-shaped connecting portion 111 electrically connectable to an unillustrated mating terminal fitting mounted in the mating housing. A barrel 112 is formed behind the connecting portion 111 and can be crimped and connected to an end part of a wire 200.

Figure 3:
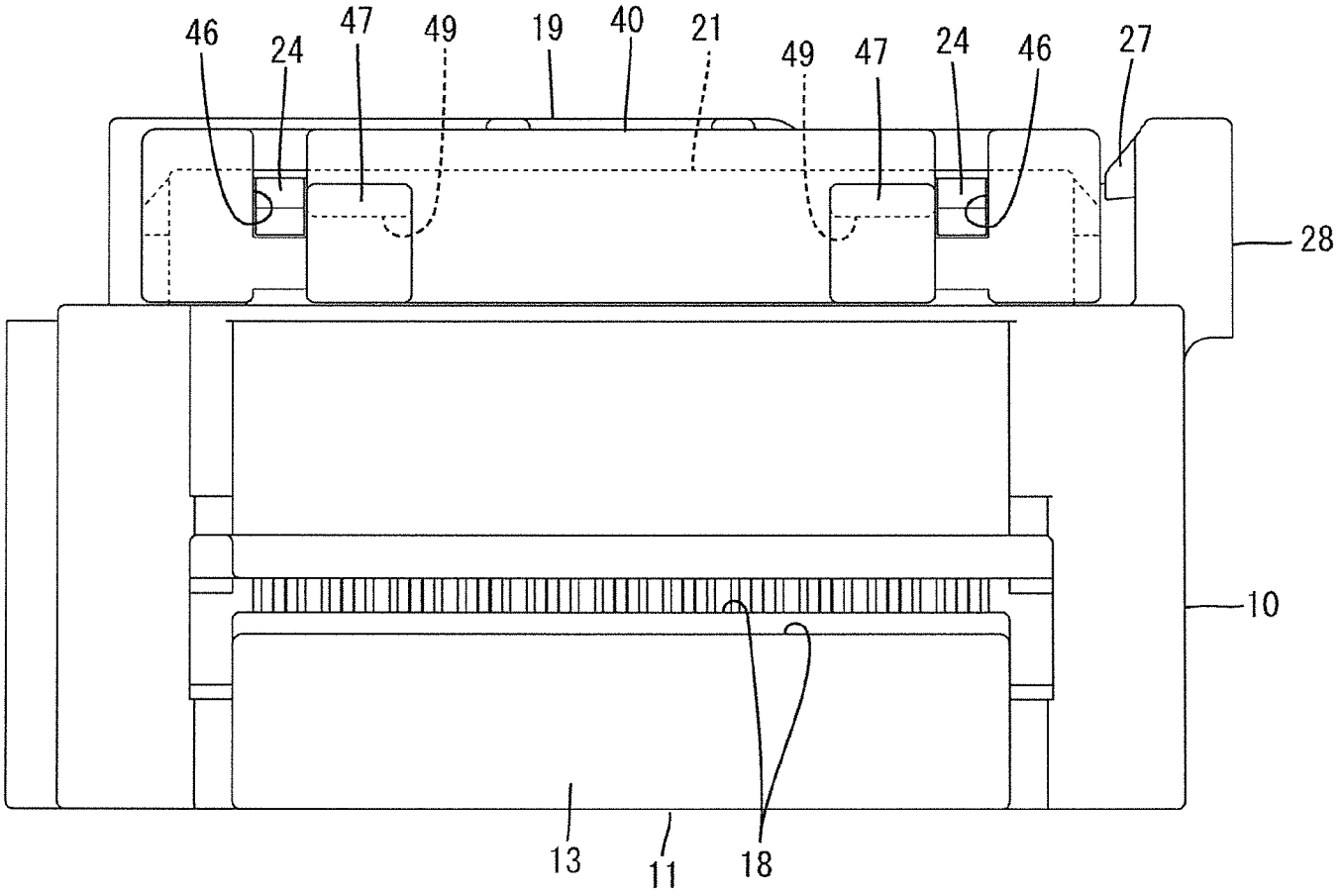
FIG. 3 is a bottom view of the housing.

As shown in FIG. 1, a slit-like retainer mounting hole 18 extends along a width direction and is open on the lower surface of the terminal accommodating portion 12. The retainer mounting hole 18 has a depth to communicate with all the cavities 16 and also is provided in the fitting tube 13, as shown in FIG. 3. An unillustrated retainer is inserted into the retainer mounting hole 18, and the terminal fittings 110 are retained doubly in the cavities 16 as the retainer is inserted properly.

Figure 4:
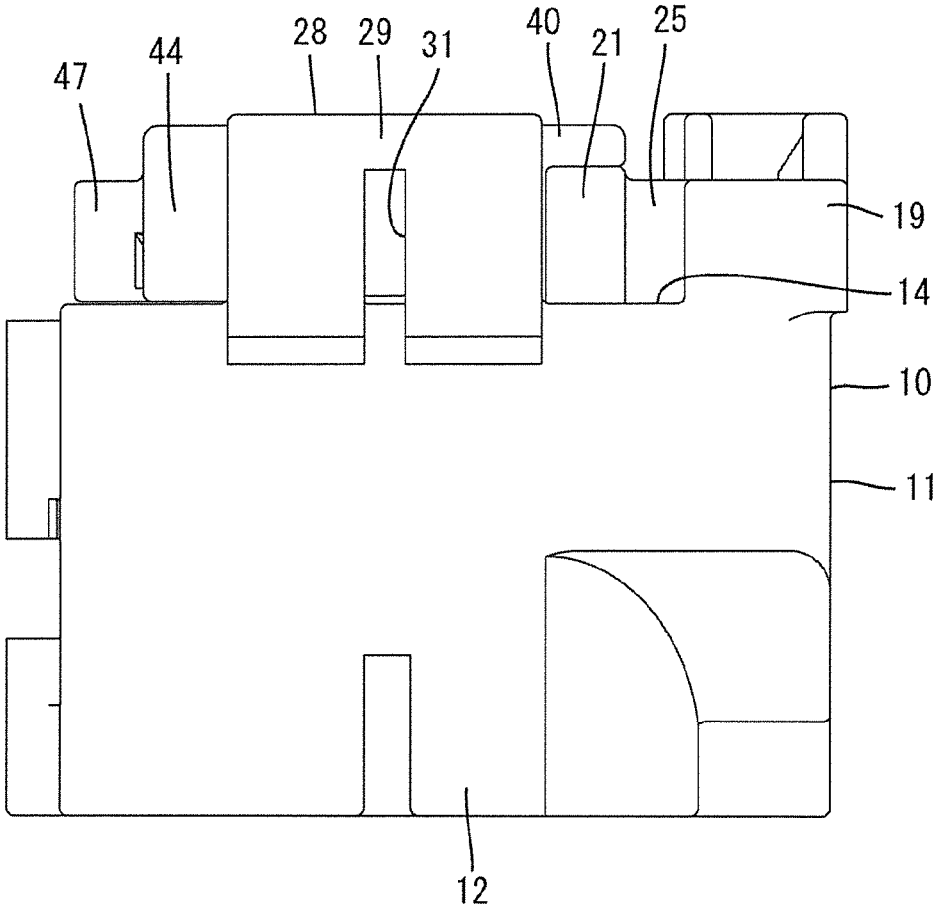
FIG. 4 is a side view of the housing.

As shown in FIG. 7, a bag-like peripheral wall 19 is provided on an upper wall of the fitting tube 13 and is long and narrow in the width direction. A lever accommodating chamber 20 capable of accommodating an unillustrated lever is provided inside the peripheral wall 19. The lever accommodating chamber 20 is in the form of a slit extending in the width direction along the upper surface of the upper wall of the fitting tube 13 and opens rearward. Further, as shown in FIG. 4, the rear end of the peripheral wall 19 projects farther back than the coupling 14 and can cover the seal 60 and the holder 40 arranged on the rear surface side of the terminal accommodating portion 12 from above. Note that the lever is rotated in a state engaged with the mating housing and pulls the mating housing toward the housing 10 to proceed with a connecting operation of the two housings by a cam action exhibited by the rotation of the lever.

Figure 8:
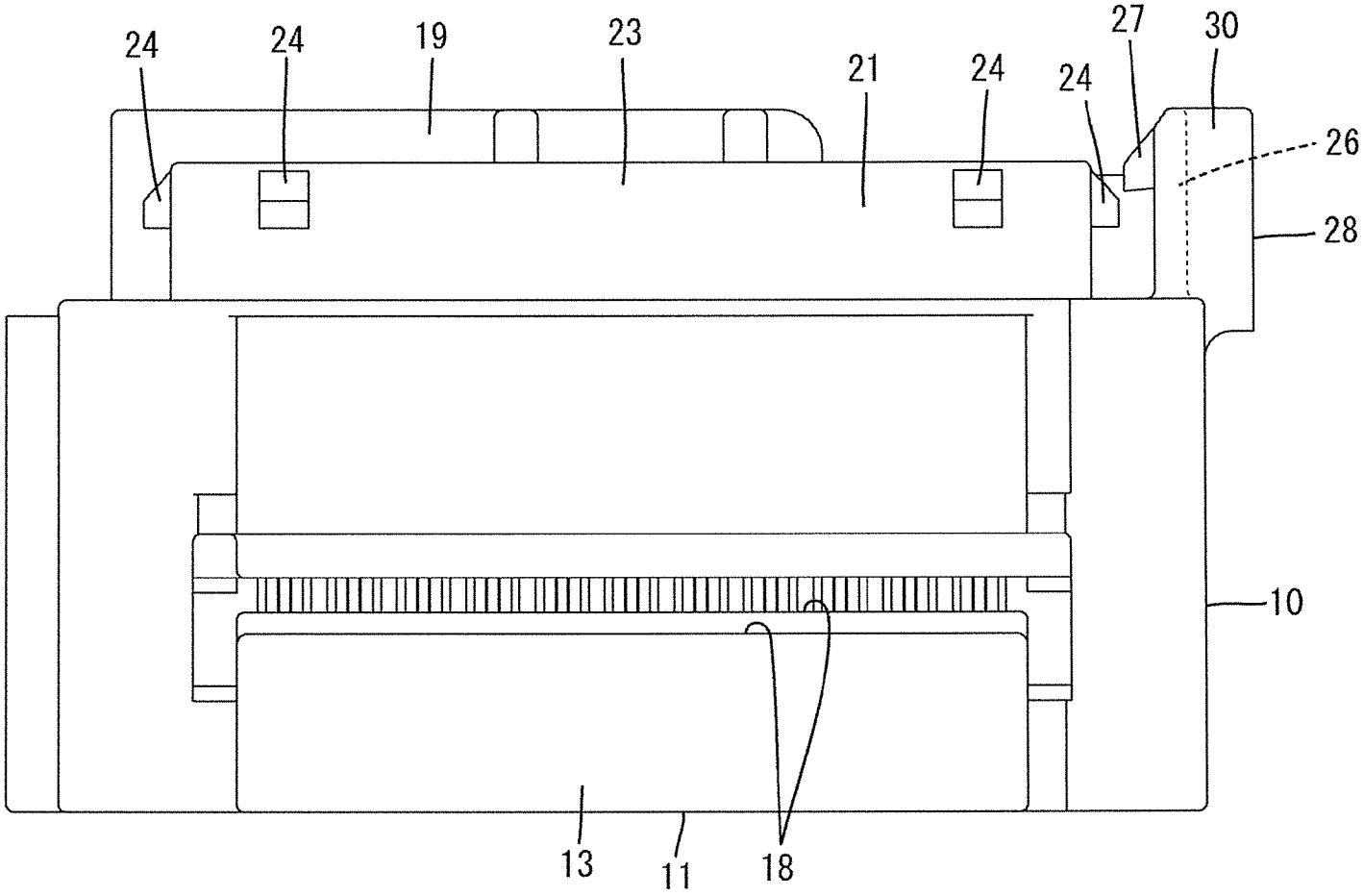
FIG. 8 is a bottom view of the housing portion.

As shown in FIG. 7, a tubular portion 21 projects from the rear surface of the coupling 14 and surrounds the outer periphery of the rear surface of the terminal accommodating portion 12. The tubular portion 21 has a substantially rectangular ring shape in a rear view. As shown in FIG. 1, the seal 60 can be fit tightly into the inside of the tubular portion 21. As shown in FIGS. 7 and 8, housing-side locks 24 project out from both opposed short sides 22 and a lower long side 23D of the tubular portion 21. Each housing-side lock 24 is in the form of a claw. One housing-side lock 24 is provided on each of the short sides 22 and two housing-side locks 24 are provided on opposite widthwise sides of the lower long side 23D.

As shown in FIG. 7, housing-side rotation center portions 25 are provided on the rear surface of the coupling 14 and are connected integrally to an upper long side 23U and the lower surface of the peripheral wall 19 facing the upper long side 23U. Specifically, the housing-side rotation center portions 25 are in the form of rectangular boxes, and insertion pieces 77 of cover-side rotation center portions 76 to be described later are inserted into the insides of the housing-side rotation center portions 25 through openings open toward a widthwise central side of the housing portion 11 and engaged in a hooked state.

Further, as shown in FIG. 7, a housing-side locking plate 26 extends at one of the opposite widthwise ends of the tubular portion 21 on the rear surface of the coupling 14. The housing-side locking plate 26 has a plate surface facing one short side 22 of the tubular portion 21 and a claw-like lock projection 27 is provided on that plate surface. The lock projection 27 is arranged eccentrically to be displaced vertically from the housing-side locking portion 24 on the one short side 22 of the tubular portion 21. The housing-side locking plate 26 is resiliently deformable in a direction so that the plate surface thereof moves away from the tubular portion 21.

As shown in FIGS. 1 and 7, a receiving portion 28 is provided at a position facing the housing-side locking plate 26 in a deflecting direction of the housing-side rotation center portion 25 on the rear surface of the coupling 14. The receiving portion 28 projects laterally (toward the right in FIG. 7) from the outer edge of the housing portion 11. Specifically, the receiving portion 28 has a plate-like receiving main body 29 arranged substantially parallel to the coupling 14 and two protecting portions 30 that project a short distance toward the tubular portion 21 from opposite upper and lower ends of receiving main body 29 to define a U-shaped cross-section. The protecting portions 30 are at opposite upper and lower sides of the housing-side locking plate 26 and cover both the housing-side locking plate 26 and the restricting member 90.

As shown in FIG. 4, the receiving main body 29 includes a receiving-side lock 31 in the form of a forwardly open slit extending in the front-back direction. Further, as shown in FIGS. 1 and 7, a rearwardly open vertically extending insertion space 32 is formed between the receiving portion 28 and the housing-side locking plate 26. The restricting member 90 is insertable into the insertion space 32 from behind. Note that the insertion space 32 also forms a deflection space for the housing-side locking plate 26.

The seal 60 is made of rubber such as silicon rubber and, as shown in FIG. 1, is a flat mat that can be fit into the tubular portion 21 for closely contacting the rear surface of the terminal accommodating portion 12. Seal holes 61 penetrate the seal 60 at positions coaxially communicating with the respective cavities 16 in the front-back direction when the seal 60 is mounted. A plurality of inner peripheral lips 62 are provided circumferentially on the inner peripheral surface of each seal hole 61 of the seal 60. Further, a plurality of outer peripheral lips 63 are provided circumferentially on the outer peripheral surface of the seal 60. When the seal 60 is mounted into the housing portion 11, the respective outer peripheral lips 63 are held resiliently in close contact with the inner peripheral surface of the tubular portion 21 and the respective inner peripheral lips 62 are held resiliently in close contact with the outer peripheral surfaces of the respective wires 200 pulled out from the cavities 16 of the terminal accommodating portion 12 to seal the housing portion 11 in a liquid-tight manner.

Figure 2:
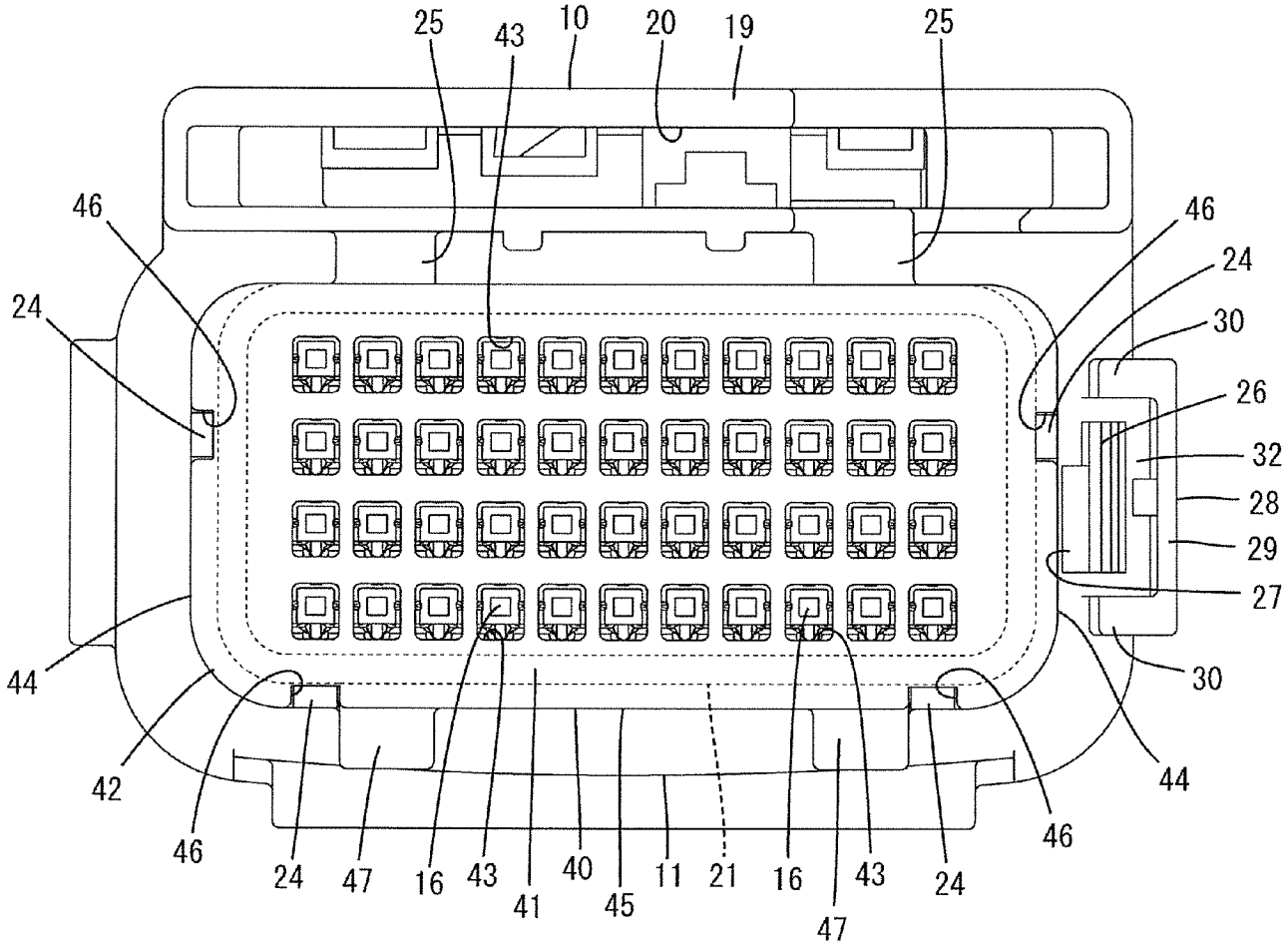
FIG. 2 is a rear view of the housing.

The holder 40 is made of synthetic resin and has a holder main body 41 for covering the rear surface of the seal 60 while being held in contact with the rear end opening edge of the tubular portion 21. A fitting wall 42 projects forward from the outer periphery of the holder main body 41 and fits externally on the outer periphery of the tubular portion 21, as shown in FIG. 1. As shown in FIG. 2, through holes 43 are penetrate the holder main body 41 at positions coaxially communicating with the respective cavities 16 and the respective seal holes 61 in the front-back direction when the holder 40 is mounted. Each through hole 43 has a rectangular cross-section configured to enable insertion of the terminal fitting 110 therethrough. The wire 200 pulled out from the seal hole 61 of the seal 60 is inserted loosely into the through hole 43. Note that the seal 60 is not shown in FIG. 2.

As shown in FIG. 2, the fitting wall 42 has opposite side walls 44 connected to opposite widthwise end parts of the holder main body 41 and a lower wall 45 connected to a lower part of the holder main body 41 to define a substantially U-shaped cross-section as a whole. Thus, the fitting wall 42 has no part connected to an upper part of the holder main body 41. This is because the upper part of the holder main body 41 is located on a side, where the housing-side rotation center portions 25 are arranged, when the holder 40 is mounted, and a space is necessary for the cover-side rotation center portions 76 to engaged with the housing-side rotation center portion 25.

Figure 5:
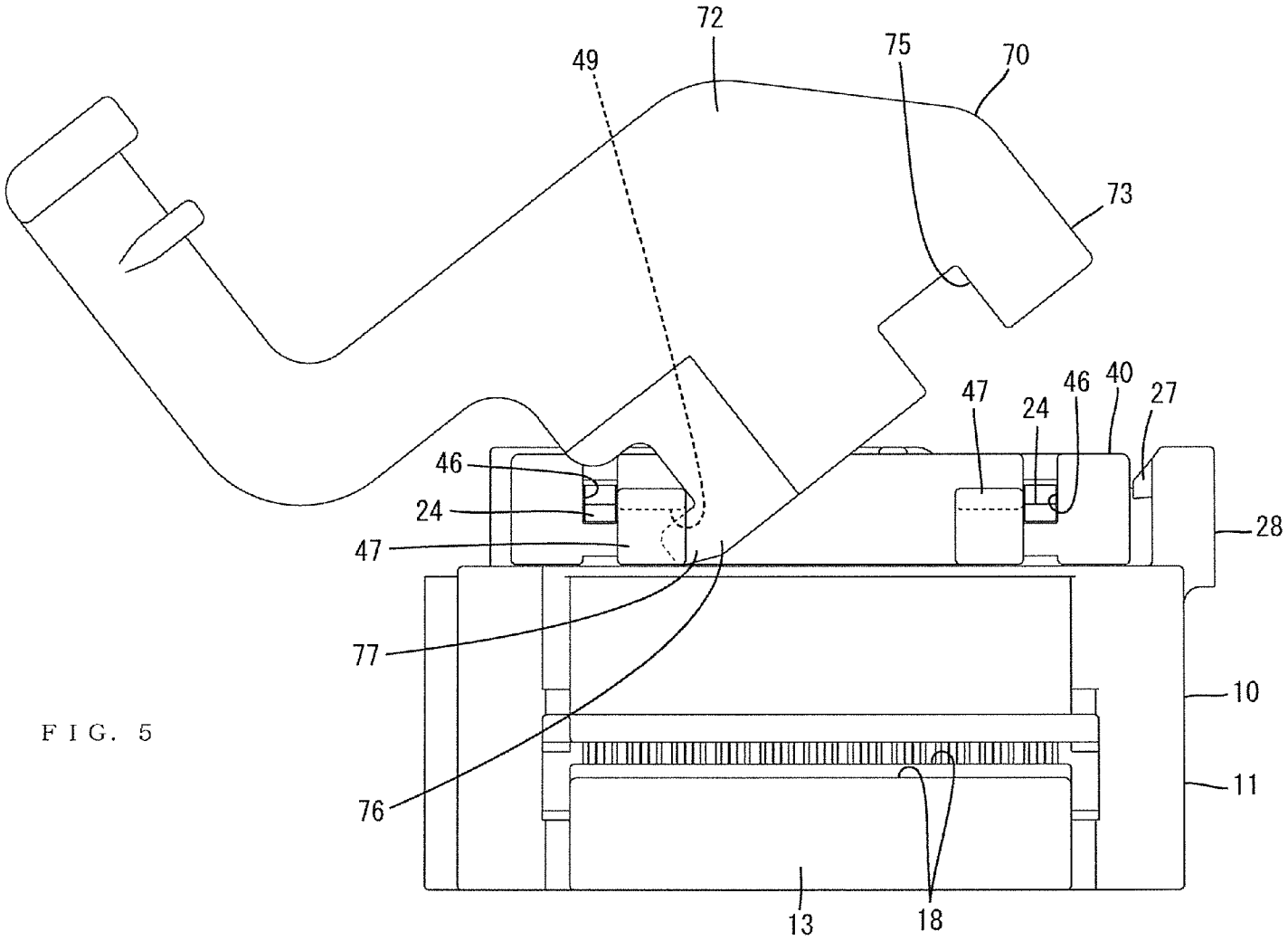
FIG. 5 is a bottom view of the connector when a wire cover is at an open position.
Figure 6:
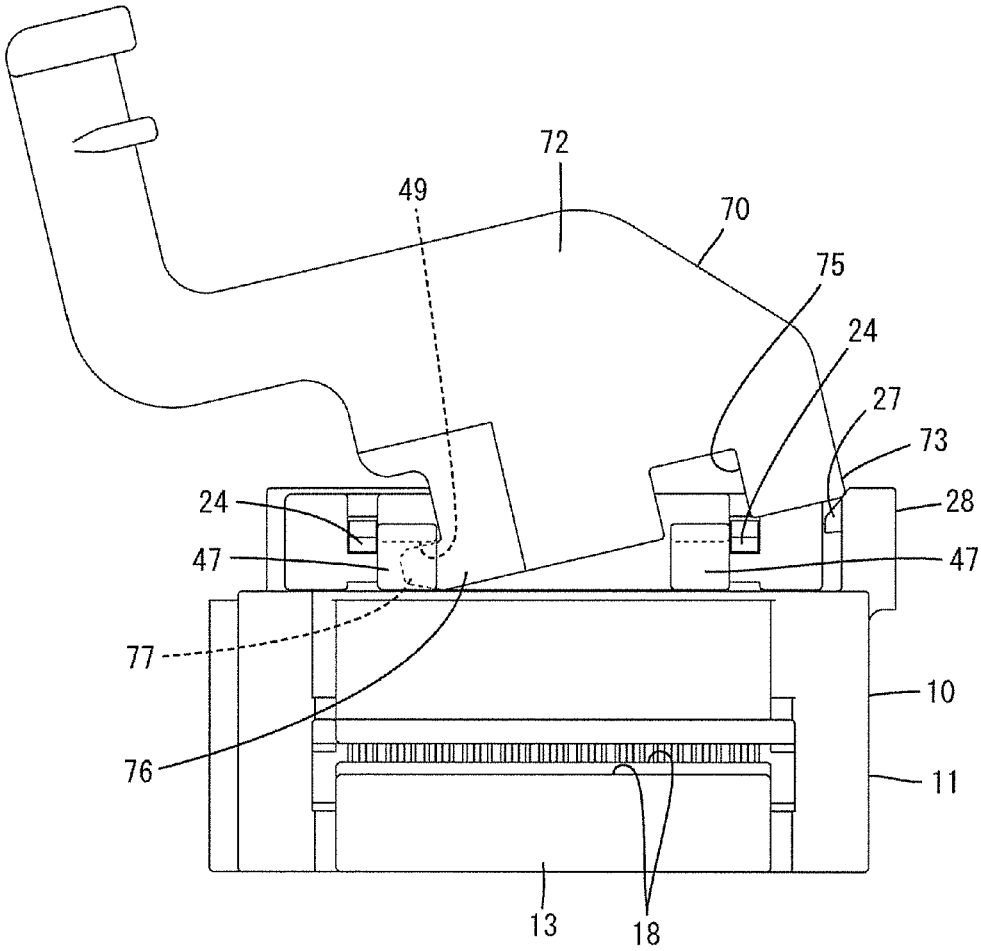
FIG. 6 is a bottom view of the connector immediately before the wire cover reaches a closed position.

As shown in FIGS. 2 and 3, holder-side locks 46 are open on the opposite side walls 44 and the lower wall 45 of the fitting wall 42 and can be locked to the housing-side locks 24 of the tubular portion 21 when the holder 40 is mounted. The holder-side locks 46 are rectangular openings that can receive the housing-side locks 24. Further, two holder-side rotation center portions 47 are provided on the lower wall 45 of the fitting wall 42 at positions coaxially facing the housing-side rotation center portions 25 in the vertical direction (rotation axis direction of the wire cover 70 to be described later) when the holder 40 is mounted. As shown in FIG. 5, the holder-side rotation center portions 47 are rectangular boxes substantially similar to the housing-side rotation center portions 25, and insertion pieces 77 of cover-side rotation center portions 76 to be described later are inserted into the insides of the housing-side rotation center portions 25 through openings 49 open toward a widthwise central side of the holder 40 and engaged in a hooked state. Further, the holder-side rotation center portions 47 are adjacent to and in parallel with the holder-side locking portions 46 of the fitting wall 42.

Figure 9:
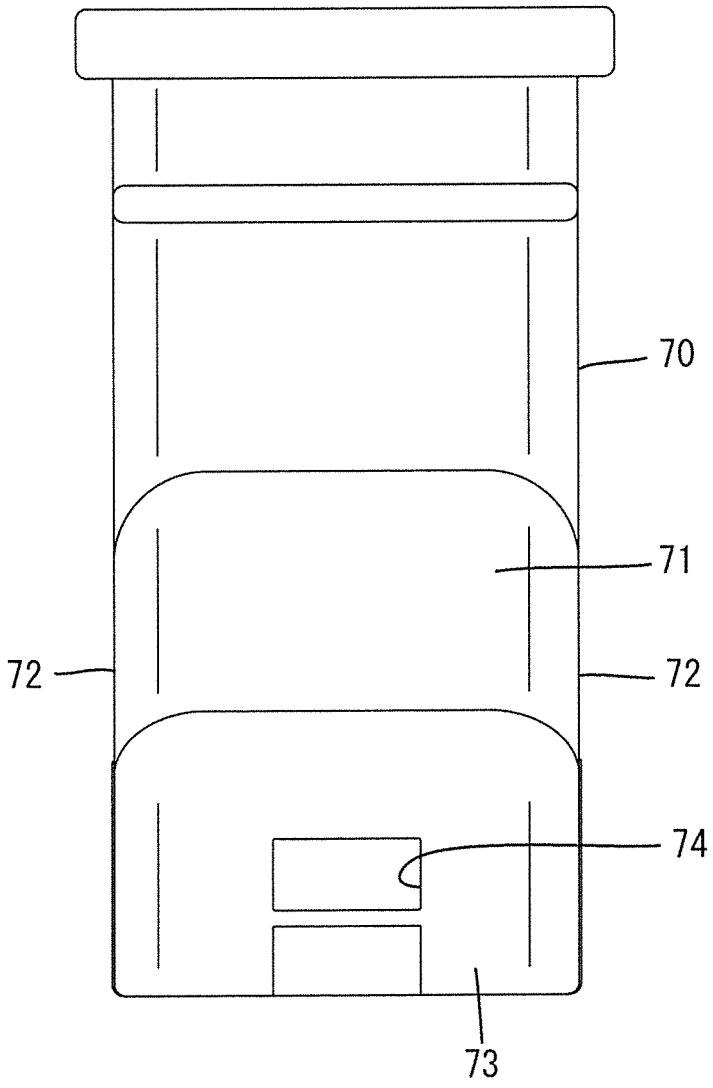
FIG. 9 is a side view of the wire cover.

The wire cover 70 is made of synthetic resin and is in the form of a cap that is open forward and sideways. The wire cover 70 is rotatable to an open position (see FIGS. 5 and 6) and a closed position (see FIG. 1) about the holder-side rotation center portion 47 and the housing-side rotation center portion 25. Specifically, as shown in FIGS. 1 and 9, the wire cover 70 has a back plate 71 arranged to face the rear surface of the holder 40 when the wire cover 70 is mounted and two side plates 72 projecting forward from opposite upper and lower edges of the back plate 72. As shown in FIG. 1, the back plate 71 has a substantially L-shape with a part to be arranged substantially along the width direction in parallel to the rear surface of the holder 40 and a part to be arranged substantially along the front-back direction. One end part of the back plate 71 is arranged substantially along the front-back direction similar to the opposite side plates 72 and constitutes a cover-side lock plate 73 that is insertable between the side wall 44 of the fitting wall 42 of the holder 40 and the receiving portion 28 when the wire cover 70 is mounted. A rectangular lock hole 74 is open on the cover-side lock plate 73 on one end part of the back plate 71 and can receive the lock projection 27 of the housing-side locking plate 26 when the wire cover 70 is mounted.

As shown in FIG. 5, the two cover-side rotation center portions 76 are provided on front end parts of the opposite side plates 72 with recesses 75 provided between the cover-side lock plate 73 and the cover-side rotation center portions 76. The cover-side rotation center portions 76 are plates extending along the width direction and include the insertion pieces 77 that project a short distance toward opposite widthwise sides in a direction away from the cover-side lock plate 73. Note that parts of the side plates 72 remote from the cover-side rotation center portions 76 are open.

Figure 10:
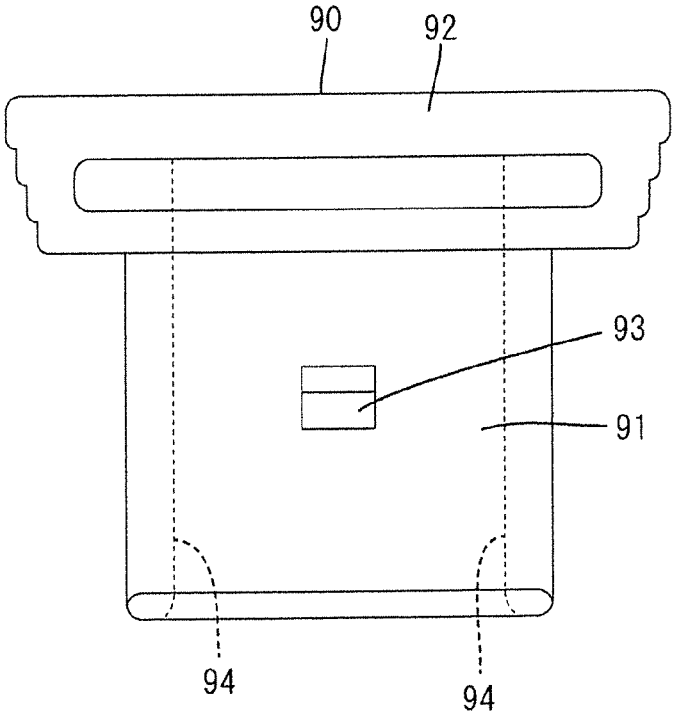
FIG. 10 is a side view of a restricting member.
Figure 11:
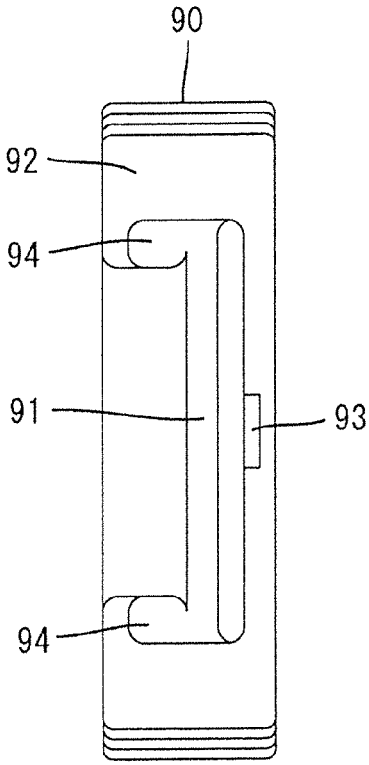
FIG. 11 is a front view of the restricting member.

The restricting member 90 is made of synthetic resin and has a plate-like shape fittable into the insertion space 32 provided between the receiving portion 28 and the housing-side locking plate 26. Specifically, as shown in FIGS. 10 and 11, the restricting member 90 includes a restricting main body 91 in the form of a thin substantially rectangular plate. An operating portion 92 in the form of a rib extends along the rear end of the restricting main body 91 and protruding up and down. As shown in FIG. 1, a claw-like key-side lock 93 projects from a plate surface of the restricting main body 91 facing the receiving-side lock 31 of the receiving portion 28 when the restricting member 90 is mounted. When the restricting member 90 is inserted properly into the insertion space 32, the key-side lock 93 is locked to the receiving-side lock 31 to hold the restricting member 90 in the insertion space 32. Further, two guides 94 extend in the front-back direction on both upper and lower end parts of the plate surface of the restricting member 91 that faces the receiving-side lock 31 of the receiving portion 28 when the restricting member 90 is mounted, as shown in FIG. 11. The guides 94 are fit between the protecting portions 30 of the receiving portion 28 and the housing-side locking plate 26 when the restricting member 90 is mounted. The guides 94 and the restricting main body 91 are arranged to embrace the housing-side locking plate 26.

When being mounted, the seal 60 is fit into the tubular portion 21 and contacts the rear surface of the terminal accommodating portion 12. Subsequently, the holder 40 is mounted on the tubular portion 21, the holder main body 41 is arranged to contact the rear surface of the seal 60 and the corresponding holder-side locks 46 are resiliently locked to the respective housing-side locks 24 of the tubular portion 21 after the fitting wall 42 is widened. Thus, the holder 40 is retained and held on the housing portion 11.

In that state, the terminal fittings 110 are inserted into the respective cavities 16 of the terminal accommodating portion 12. The terminal fitting 110 reaches the cavity 16 by way of the through hole 43 of the holder 40 and the seal hole 61 of the seal 60, and the wire 200 is inserted into the seal hole 61 in a liquid-tight manner while being loosely inserted into the through hole 43.

Subsequently, the wire cover 70 is mounted in an oblique posture onto the housing 10 from a lateral side and the insertion pieces 77 of the cover-side rotation center portions 76 are inserted into the insides of the housing-side rotation center portion 25 and the holder-side rotation center portion 47 through the openings 49 (see FIG. 5). In that state, the wire cover 70 is rotated toward the closed position about these rotation center portions 25, 47 and 76 while the insertion pieces 77 are inclined inside the housing-side rotation center portion 25 and the holder-side rotation center portion 47 (see FIGS. 5 and 6).

When the wire cover 70 reaches the closed position, the cover-side lock plate 73 is locked resiliently to the housing-side locking plate 26 and the wire cover 70 is held on the housing 10 (see FIG. 1). At the closed position, the edge of the front end of the wire cover 70 is substantially entirely in contact with the rear surface of the coupling 14 and the wires 200 pulled out from the respective through holes 43 of the holder 40 are forcibly bent by the back plate 71 and drawn out to outside along the back plate 71. Further, at the closed position, the other housing-side rotation center portion 25 and holder-side rotation center portion 47 not engaged with the cover-side rotation center portions 76 are inserted into the recesses 75 of the wire cover 70 to escape. Note that the other housing-side rotation center portion 25 and holder-side rotation center portion 47 not engaged with the cover-side rotation center portions 76 are applied to an unillustrated other connector on which a housing-side locking plate 26 and a receiving portion 28 are arranged at a side opposite to that of this embodiment and engageable with cover-side rotation center portions 76 of a wire cover 70 of that other connector.

Subsequently, the restricting member 90 is inserted into the insertion space 32 between the housing-side locking plate 26 and the receiving portion 28 while the operating portion 92 is gripped (see FIG. 1). When the restricting member 90 is inserted properly into the insertion space 32, the key-side lock 93 is locked to the receiving-side lock 31 and the restricting main body 91 of the restricting member 90 is arranged so that a surface thereof opposite to the one locked to the receiving-side lock portion 31 can be held in contact with the plate surface of the housing-side locking plate 26. In this way, the deflection of the housing-side locking plate 26 is restricted so that the wire cover 70 is held reliably on the housing 10 in a state where detachment thereof is restricted.

If the cover-side lock plate 73 is left in a half-locked state without being properly locked to the housing-side locking plate 26, the insertion of the restricting member 90 into the insertion space 32 is restricted. Thus, it can be known that the wire cover 70 has not reached the proper closed position.

As described above, the cover-side lock plate 73 and the housing-side locking plate 26 are locked properly together so that the wire cover 70 is held on the housing 10. The restricting member 90 is inserted into the insertion space 32, which is the deflection space for the housing-side locking plate 26. Thus, deflection of the housing-side locking plate 26 is restricted. An external force may act in a direction to detach the wire cover 70 from the housing 10. However, the housing-side locking plate 26 is not easily deformed by such an external force and the wire cover 70 is kept satisfactorily on the housing 10. As a result, the wire cover 70 is prevented from being inadvertently detached from the housing 10. Particularly, the wire cover 70 easily returns to the open position rotationally about the rotation center portions 25, 47 and 76 if an external force acts to rotate the wire cover 70 at the closed position toward the open position. Thus, it is very beneficial to prevent the detachment of the wire cover 70 by restricting the deflection of the housing-side locking plate 26 by the restricting member 90.

The wire cover 70 is rotated in a state where the cover-side rotation center portions 76 are supported in the holder-side rotation center portion 47 and the housing-side rotation center portion 25 and the holder-side rotation center portions 47 are provided integrally to the fitting wall 42 of the holder 40, i.e. a structure for supporting the wire cover 70 is provided without defining any clearance between this structure and the holder 40. Thus, space efficiency is excellent and the enlargement of the connector can be prevented.

The holder-side rotation center portions 47 are provided at one side on a rotation axis of the wire cover 70 and the housing-side rotation center portions 25 are provided at the other side. Thus, if it is attempted to mount the holder 40 on the rear surface of the housing portion 11 in a posture inverted from a proper posture with respect to a center of the rotation axis, the holder-side rotation center portions 47 and the housing-side rotation center portions 25 interfere with each other to prevent any further mounting operation of the holder 40. As a result, erroneous mounting of the holder 40 is prevented. Further, since the peripheral wall 19 of the lever accommodating chamber 20 is reinforced by the housing-side rotation center portions 25, the lever is stably accommodated in the lever accommodating chamber 20.

The invention is not limited to the above described and illustrated embodiment. For example, the following embodiments are also included in the technical scope of the present invention.

Contrary to the embodiment, the cover-side lock portion may be resiliently deformable and the restricting member may be inserted into a deflection space for the cover-side lock portion to restrict the deflection of the cover-side lock portion.

The restricting member may be coupled integrally to the wire cover or the housing.

The housing-side rotation center portions may be omitted and a pair of holder-side rotation center portions may be provided at positions on the rotation axis of the wire cover.

LIST OF REFERENCE SIGNS

10 . . . housing
11 . . . housing portion
16 . . . cavity
19 . . . peripheral wall
20 . . . lever accommodating chamber
24 . . . housing-side locking portion
25 . . . housing-side rotation center portion
26 . . . housing-side lock portion
28 . . . receiving portion
32 . . . insertion space
40 . . . holder
43 . . . through hole
47 . . . holder-side rotation center portion
60 . . . seal member
61 . . . seal hole
70 . . . wire cover
73 . . . cover-side lock portion
76 . . . cover-side rotation center portion
90 . . . restricting member
110 . . . terminal fitting
200 . . . wire

What is claimed is:

1. A connector, comprising:

a housing having a terminal accommodating portion with at least one cavity penetrating through the terminal accommodating portion in forward and backward directions, a tubular projection projecting rearward from the terminal accommodating portion and a housing side rotation center portion projecting from a rear surface of the tubular portion;

at least one terminal fitting connected to an end part of a wire and inserted into the at least one cavity;

a seal arranged on a rear surface side of the terminal accommodating portion and including at least one seal hole at a position communicating with the at least one cavity, the wire pulled out from the rear surface of the housing being disposed in the at least one seal hole in a liquid-tight manner;

a holder arranged on a rear surface of the seal and including a through hole at a position communicating with the seal hole, the wire pulled out from the rear surface of the seal being loosely disposed in the through hole, at least one holder side rotation center portion projecting from the holder at a position facing the at least one housing side rotation portion; and a wire cover including first and second cover-side rotation center portions engaging the at least one housing side rotation center portion and the at least one holder side projecting portion, respectively, wherein the wire cover is rotatable about the at least one housing side rotation center portion and the at least one holder side rotation center portion between an open position in which the wire cover is at an oblique posture with respect to the holder, and a closed position in which the wire cover covers the wire pulled out from the holder.

2. The connector of claim 1, wherein the housing includes a lever accommodating chamber, and the housing-side rotation center portion is coupled integrally to a peripheral wall of the lever accommodating chamber.

3. The connector of claim 1, wherein the holder includes a main body portion arranged on the rear surface of the seal, and a U-shaped fitting wall projecting from the main body portion, the U-shaped fitting wall having opposite first and second side walls and a lower wall extending between ends of the first and second side walls.

4. The connector of claim 3, wherein the U-shaped fitting wall is fit externally on the tubular portion of the housing with the lower wall opposite the at least one housing side rotation center portion.

5. The connector of claim 4, wherein the at least one holder side rotation center portion projects from the lower wall.

6. The connector of claim 1, wherein the at least one housing side rotation center portion and the at least one holder side rotation center portion have equal projecting heights.

7. The connector of claim 1, wherein the wire cover includes a back plate and opposite first and second side plates projecting forward from the back plate, and the first and second cover-side rotation center portions project respectively from the first and second side plates.

8. The connector of claim 1, wherein at least one holder side rotation center portion is formed on a first side of a rotation axis of the wire cover, and the at least one housing side rotation center portion is formed on a second side of the rotation axis of the wire cover, opposite the first side.

* * * * *